US006695138B1

(12) United States Patent
Colombo et al.

(10) Patent No.: US 6,695,138 B1
(45) Date of Patent: Feb. 24, 2004

(54) FOOD PACKAGE WITH INTEGRAL JUICE ABSORBING BOTTOM

(75) Inventors: Edward A. Colombo, Penfield, NY (US); Jeffrey J. Braddon, Bloomfield, NY (US)

(73) Assignee: Commodaic Machine Co. Inc., Bloomfield, NY (US)

( * ) Notice: Subject to any disclaimer, the term of this patent is extended or adjusted under 35 U.S.C. 154(b) by 0 days.

(21) Appl. No.: 10/300,256

(22) Filed: Nov. 20, 2002

Related U.S. Application Data

(63) Continuation-in-part of application No. 10/280,034, filed on Oct. 24, 2002, and a continuation-in-part of application No. 09/906,280, filed on Jul. 16, 2001, now Pat. No. 6,520,323.

(51) Int. Cl.[7] ..... B65D 81/26

(52) U.S. Cl. ..... 206/204; 206/557; 426/124; 426/129; 428/36.5

(58) Field of Search ..... 206/204, 205, 206/213.1, 557, 564; 229/406, 407; 426/124, 129; 428/36.5

(56) References Cited

U.S. PATENT DOCUMENTS

| | | | | | |
|---|---|---|---|---|---|
| 3,521,806 | A | * | 7/1970 | Esty | 229/117.3 |
| 3,574,642 | A | * | 4/1971 | Weinke | 426/124 |
| 3,681,092 | A | * | 8/1972 | Titchenal et al. | 426/412 |
| 4,247,517 | A | * | 1/1981 | Sanderson et al. | 422/300 |
| 4,372,921 | A | * | 2/1983 | Sanderson et al. | 422/300 |
| 4,548,824 | A | * | 10/1985 | Mitchell et al. | 426/111 |
| 5,332,121 | A | * | 7/1994 | Schmidt et al. | 222/95 |
| 5,561,915 | A | * | 10/1996 | Vandergriff | 34/201 |
| 5,628,404 | A | * | 5/1997 | Hendrix | 206/524.8 |
| 5,667,827 | A | * | 9/1997 | Breen et al. | 426/129 |
| 5,698,250 | A | * | 12/1997 | DelDuca et al. | 426/124 |
| 5,705,210 | A | * | 1/1998 | Sillince et al. | 426/112 |
| 5,711,978 | A | * | 1/1998 | Breen et al. | 426/129 |
| 5,720,999 | A | | 2/1998 | Lanzani et al. | |
| 5,731,023 | A | * | 3/1998 | Milani | 426/410 |
| 5,811,142 | A | * | 9/1998 | DelDuca et al. | 426/124 |
| 5,833,894 | A | | 11/1998 | Lanzani et al. | |
| 5,916,613 | A | * | 6/1999 | Stockley, III | 426/124 |
| 5,950,402 | A | * | 9/1999 | Hoddinott | 53/432 |
| 6,054,153 | A | * | 4/2000 | Carr et al. | 426/87 |
| 6,093,751 | A | | 7/2000 | Federico et al. | |
| 6,152,295 | A | | 11/2000 | Brander et al. | |
| 6,216,855 | B1 | * | 4/2001 | Grone | 206/204 |
| 6,235,360 | B1 | | 5/2001 | Lanzani et al. | |
| 6,257,401 | B1 | | 7/2001 | Mangla et al. | |
| 6,274,232 | B1 | | 8/2001 | Otten et al. | |
| 6,279,581 | B1 | * | 8/2001 | Knepper | 131/329 |
| 6,279,738 | B1 | * | 8/2001 | Mungo et al. | 206/213.1 |
| RE37,780 | E | | 7/2002 | Lanzani et al. | |

FOREIGN PATENT DOCUMENTS

| | | | |
|---|---|---|---|
| JP | 4-242572 | * | 8/1992 |

* cited by examiner

*Primary Examiner*—Jim Foster
(74) *Attorney, Agent, or Firm*—Howard J. Greenwald

(57) ABSTRACT

A juice absorbing food package comprising a tray having a bottom bounded by an upwardly extending lip around the perimeter of the bottom and a liquid-absorbing pad comprised of polymer foam joined to the bottom of said tray, wherein the polymer foam is open cell foam. The tray of the juice absorbing package is overwrapped with gas permeable film, and may be provided with an oxygen absorbing substance therein. Alternatively, the overwrapped tray may be placed in a sealed barrier bag that is subsequently purged with a non-oxidizing gas such as carbon dioxide.

34 Claims, 10 Drawing Sheets

FOOD PACKAGE WITH INTEGRAL JUICE ABSORBING BOTTOM

CROSS REFERENCE TO RELATED PATENT APPLICATION

This application is a continuation-in-part of copending application U.S. Ser. No. 10/280,034, filed Oct. 24, 2002 CIP application U.S. Ser. No. 09/906,280, filed Jul. 16, 2001 now U.S. Pat. No. 6,520,323.

This invention relates in one embodiment to disposable and/or recyclable packaging trays for retail sale of food at supermarkets, grocery stores, delicatessens, and the like, and more particularly to the packaging of juice-containing meats and poultry products for sale in such establishments.

FIELD OF THE INVENTION

Containers for packaging, preservation, and display of juice-containing foods at retail sales locations.

BACKGROUND OF THE INVENTION

Sales of juice-containing foods, particularly meats, packaged in individual trays are common in supermarkets, grocery stores, and delicatessens. It is common to package such foods in polymer foam trays, since such foam trays are lightweight, structurally strong, inexpensive, and sanitary. Such containers also are shaped to be nested closely to each other, so that a large number of containers can be shipped in a small volume shipping box.

However, while such foam trays are effective at containing juices leaked from meat held therein, if maintained in a substantially level orientation, they are not suitable for absorbing leaked juices. Such foam trays are typically made from closed-cell polymer foam, which is not wet by water and water-based juices. In addition, there is no pathway for juices to enter the void volume of the cells of such polymer foam, as the cells are closed and impermeable to water.

Absorbent open cell polymer foams are known, but a food tray formed of such open cell foam is unsatisfactory, because juices will leak through the foam wall, discolor the inside of the tray and escape from the container, and also, such open cell foam is not as structurally strong as closed cell foam. Alternatively, the practice of placing an absorbent fabric pad between the foam tray and the meat is practiced, but such practice is also unsatisfactory. Examples of such absorbent pads comprising fabric and/or fibers are provided in U.S. Pat. No. 5,320,895 of Larsonneur et al, and U.S. Pat. No. 6,278,371 of Hopkins, the disclosures of which are incorporated herein by reference. When customers examine and inspect the meat by holding and manipulating the tray, such meat may slide within the tray, and the proper orientation of the pad and the meat may be disrupted. Additionally these fabric pads release absorbed juices when subjected to physical pressure by the consumer and so do not provide for a consumer acceptable product.

There is also the practice of simply packaging meat in such closed cell trays with no absorptive pad, but such practice is also unsatisfactory. When customers examine and inspect the meat by holding and manipulating a non-absorbing tray, and orient the tray vertically, the juice contained therein may leak out at the junction of the edge of the tray and the stretch-wrap film applied around the tray. In addition, the visual appearance of the bloodred juices flowing within the tray during inspection may provide a negative impression on the consumer.

Like many consumer products, a decision to purchase a food is often made based on both visual appeal and practical considerations. Thus there is a need for a meat package, which has juice absorbing properties, and which is of sufficient structural strength to support meat held therein during handling, and during transportation of the meat to the display location, the checkout/purchase counter, and to the customer's home.

It is an object of this invention to provide a simple, inexpensive food package with high structural strength and with juice absorbing capability.

It is a further object of this invention to provide a food package with juice absorbing capability and oxygen absorbing capability.

It is another object of this invention to provide a food package with juice absorbing capability and with a non-oxidizing atmosphere therein.

SUMMARY OF THE INVENTION

In accordance with the present invention, there is provided a food package comprising a tray having a bottom bounded by an upwardly extending lip around the perimeter of said bottom and a liquid-absorbing pad comprised of polymer foam joined to said bottom of said tray, wherein said polymer foam is comprised of between about 20 to about 90 percent open cells, said polymer foam has an average cell diameter of between about 1 and about 10 mils, said polymer foam has a density of between about 1 and about 20 pounds per cubic foot, and said polymer foam has a contact angle when placed in contact with water of about 0 to about 70 degrees.

In accordance with the present invention, there is provided such a food package further comprising a film overwrapping around the tray, and an oxygen absorbing substance disposed within the tray.

In accordance with the present invention, there is provided such a food package further comprising the film overwrapping and the tray disposed within a barrier bag, wherein a non-oxidizing gas is also disposed within the barrier bag.

BRIEF DESCRIPTION OF THE DRAWINGS

The invention will be described by reference to the following drawings, in which like numerals refer to like elements, and in which:

FIG. 1A is a top view of a unitary closed cell foam tray of the prior art, used in packaging, and retail sale of meats, seafood, and the like;

Figure 1A:
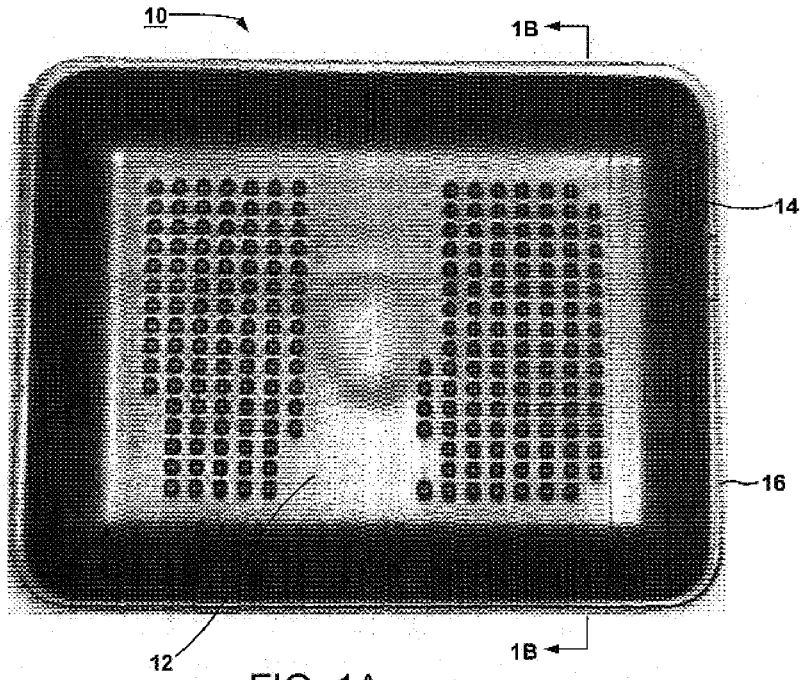

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENTS

For a general understanding of the present invention, reference is made to the drawings. In the drawings, like reference numerals have been used throughout to designate identical elements.

Figure 1B:
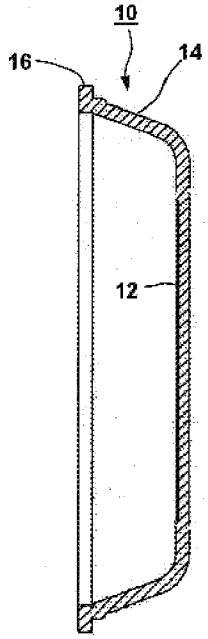
FIG. 1B is a sectional view of the closed cell foam tray of FIG. 1A, taken along to line 1B—1B of FIG. 1A.

FIG. 1A is a top view of a unitary closed cell foam tray of the prior art, used in packaging, and retail sale of meats, seafood, and the like. FIG. 1B is a sectional view of the closed cell foam tray of FIG. 1A, taken along line 1B—1B of FIG. 1A. Referring to FIGS. 1A and 1B, foam tray 10 comprises a substantially flat bottom 12, bounded by an upwardly extended lip 14 around the entire perimeter 16 thereof. In use, a food product (not shown) such as, e.g. a piece of meat, poultry, or fish is placed upon bottom 12 of tray 10, tray 10 is typically fully wrapped with clear stretch wrap film (not shown), thereby enclosing the food therein. Juices leaked from such food are retained within tray 10 by lip 14, as long as tray 10 is maintained in a substantially horizontal position.

Figure 2A:
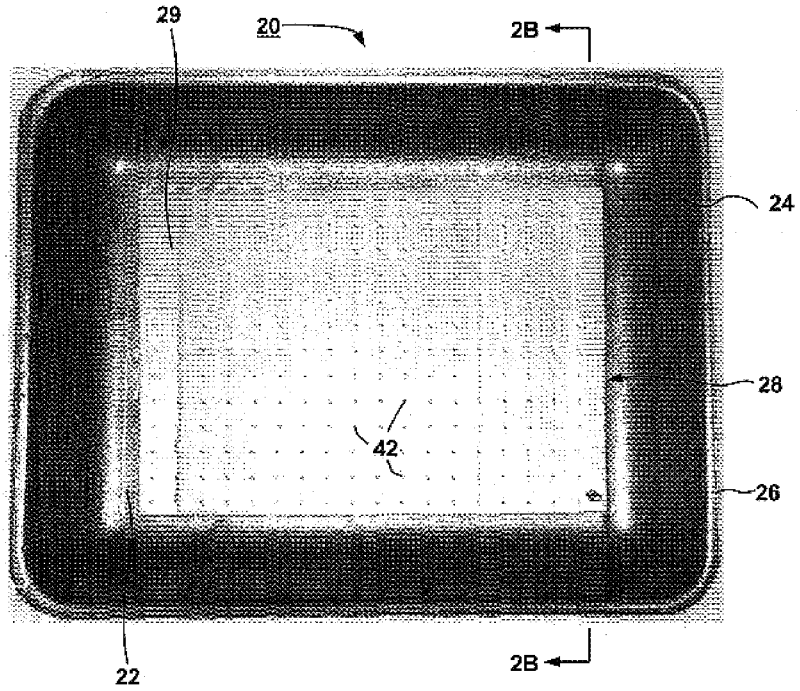
FIG. 2A is a top view of a first embodiment of the juice-absorbing package of the present invention.
Figure 2B:
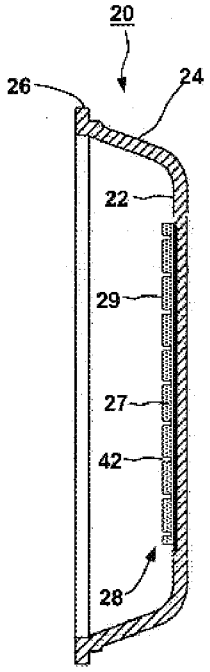
FIG. 2B is a sectional view of the juice-absorbing package of FIG. 2A, taken along line 2B—2B of FIG. 2A.

FIG. 2A is a top view of a first embodiment of the juice-absorbing package of the present invention. FIG. 2B is a sectional view of the juice-absorbing package of FIG. 2A, taken along line 2B—2B of FIG. 2A. Referring to FIGS. 2A and 2B, juice-absorbing package 20 comprises a substantially flat bottom 22 bounded by an upwardly extended lip 24 around the entire perimeter 26 thereof, and a juice absorbing pad 28 suitably joined to the bottom 22 of tray 20. Juice absorbing pad 28 may joined to the bottom 22 of tray 20 by a suitable liquid adhesive (not shown) applied to bottom 22, prior to engagement with pad 28, or by application of adhesive (not shown) around the perimeter 30 of pad 28, or by heat seal means, or by application of a double sided adhesive tape (not shown) to bottom 22 of tray 20, or to the underside of pad 28, prior to the engagement of pad 28 with bottom 22 of tray 20.

In one preferred embodiment, juice-absorbing pad 28 is made of a wafer of hydrophilic open cell foam, such that it is wettable, and absorbs water. In one more preferred embodiment, such open cell foam wafer is made from a resin selected from the group consisting of polyethylene, polyvinyl chloride, polyacrylonitrile (such as the "BAREX" resin sold by the British Petrolem/Amoco company), poly (ethylene terephthalate), polystyrene, rubber-modified polystyrene, ethylene viny acetate(EVA),mixtures of polystyrene and EVA, ethylenepolystyrene, interpolymers (such as "INDEX" interpolymers sold by Dow Chemical Corporation of Midland Michigan), polypropylene, polyurethane, polyisocyanurate, epoxy, urea formadehyde, rubber latex, silicone, fluropolymer or copolymers thereof or blends thereof.

In one embodiment, depicted in FIGS. 2A and 2B, juice absorbing pad 28 comprises an upwardly disposed impermeable surface 29 having a plurality of perforations 42 disposed therethrough. When juices leak from a piece of food (not shown), that is placed within juice absorbing package 20 upon surface 29, such juices flow through perforations 42, and are absorbed by the porous open cell inner core 27 of pad 28.

In a further embodiment, juice-absorbing pad 28 is joined to the bottom 22 of tray 20 by use of a solvent that will partially dissolve or soften both tray 20 and juice absorbing pad 28. With the mating surfaces of tray 20 and juice absorbing pad 28 partially dissolved and in a liquid or plastic state, when such surfaces of tray 20 and juice absorbing pad 28 are engaged with each other, a strong bond there between is provided after the evaporation of the solvent occurs. In one example of such an embodiment, a tray of polystyrene closed cell foam was bonded to a wafer of water absorbing polystyrene open cell foam with 70% open cells by the use of a mixture of ortho-, meta-, and para-xylenes. Other suitable bonding solvents include acetone, and mixtures of xylenes and methyl alcohol, or similar solvents that at least partially dissolve polystyrene.

Figure 3B:
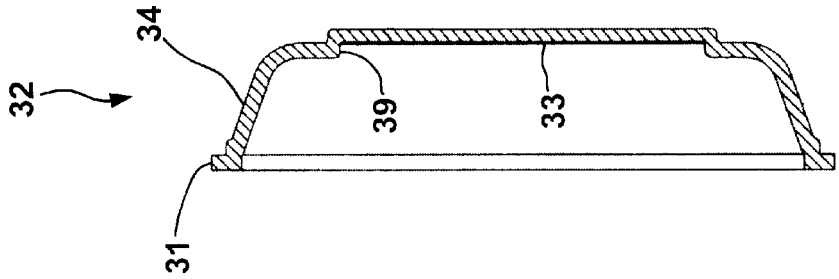
FIG. 3B is a sectional view of the juice-absorbing package of FIG. 3A, taken along line 3B—3B of FIG. 3A.
Figure 3A:
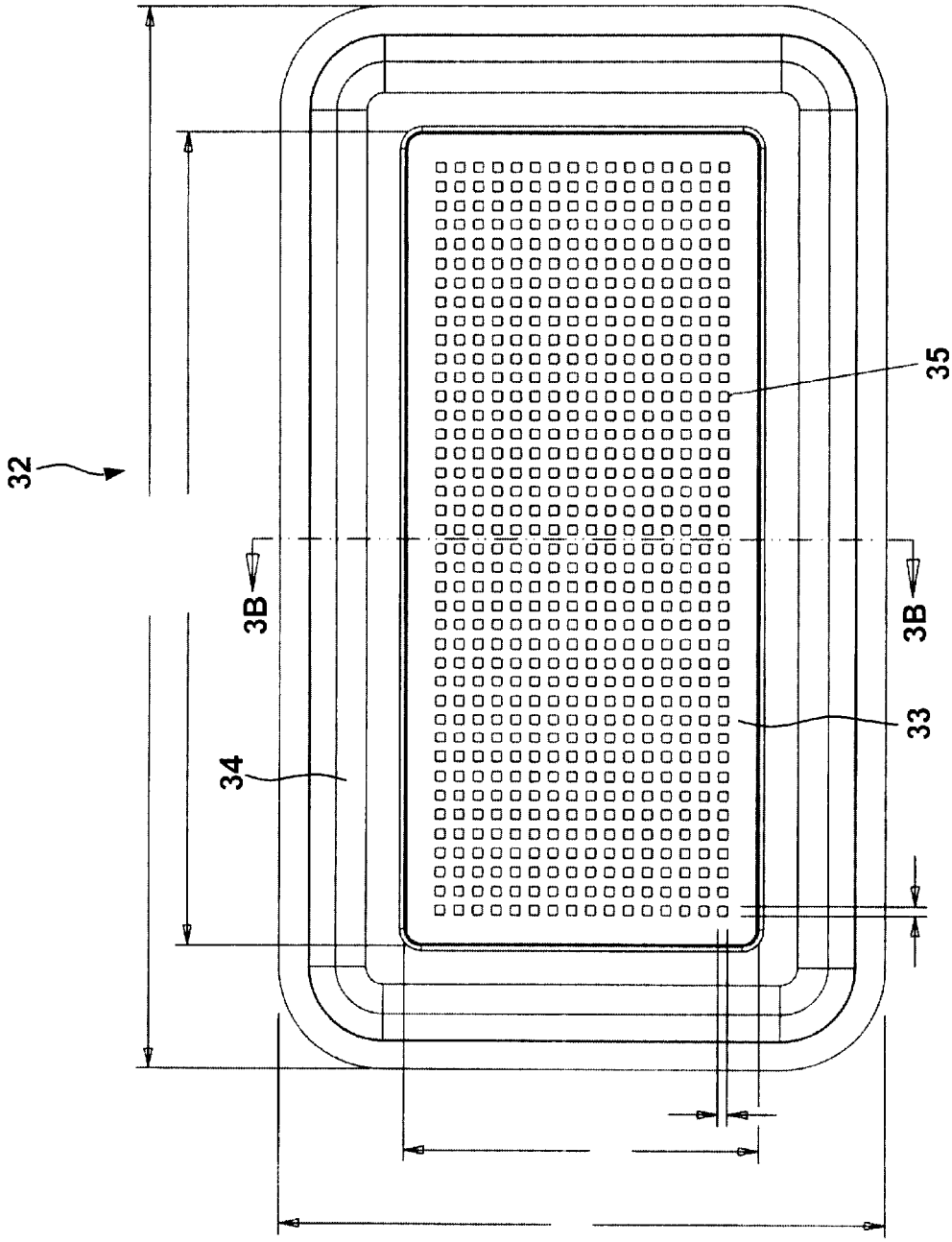
FIG. 3A is a top view of a closed cell foam tray that is used as one part of the juice absorbing package of the present invention.

FIGS. 3A–6B depict aspects of a more preferred embodiment of applicants' juice absorbing package, in unassembled and assembled states. FIG. 3A is a top view of a preferred foam tray that is used as the main container of applicants' preferred juice absorbing package. FIG. 3B is a sectional view of the juice-absorbing package of FIG. 3A, taken along line 3B—3B of FIG. 3A. Referring to FIGS. 3A and 3B, foam tray 32 comprises a substantially flat bottom 33, bounded by an upwardly extended lip 34 around the entire perimeter 31 thereof. In one embodiment, foam tray 32 comprises an array of indented or protruding dimples 35 disposed on bottom 33

In the preferred embodiment, foam tray 32 further comprises a step 39 disposed around the perimeter of flat bottom 33, such that a substantially rectangular recessed or countersunk volume is formed within foam tray 32 by step 39 and flat bottom 33. This countersunk volume provides a space within tray for the placement of a juice absorbing pad therein as depicted in FIG. 6B, the details of which will be explained subsequently in this specification.

Figure 4A:
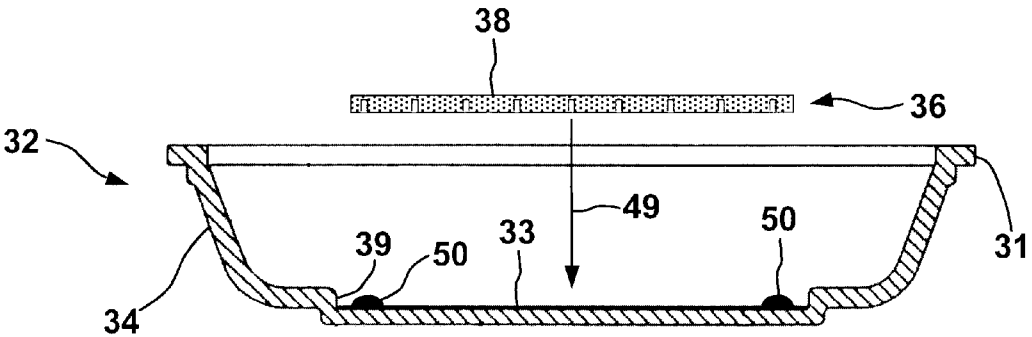
FIG. 4A is a sectional view of the tray of FIG. 3B, and a preferred juice absorbing pad, prior to assembly thereof to form a preferred juice absorbing package.

FIG. 4A is a sectional view of the tray of FIG. 3B, and a preferred juice absorbing pad, prior to assembly thereof to form a preferred juice absorbing package. Referring to FIG. 4A, juice absorbing pad 36 comprises a porous open cell inner core 37 bounded by an intact smooth skin 38 on one side, and a perforated smooth skin 40 on the other side. In the preferred embodiment, juice absorbing pad 36 is joined to foam tray 32 with the perforated skin 40 positioned adjacent to bottom 33 of tray 32. Juice absorbing pad 36 is preferably joined to foam tray 32 by a plurality of adhesive dots 50.

Figure 4B:
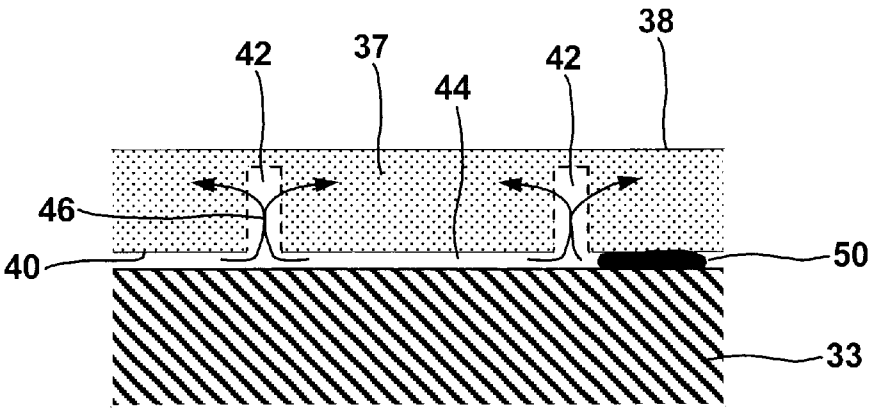
FIG. 4B is a detailed view of a portion of the juice absorbing pad and tray bottom depicted in the sectional view of FIG. 6B, after the juice absorbing pad and tray have been assembled together
Figure 5A:
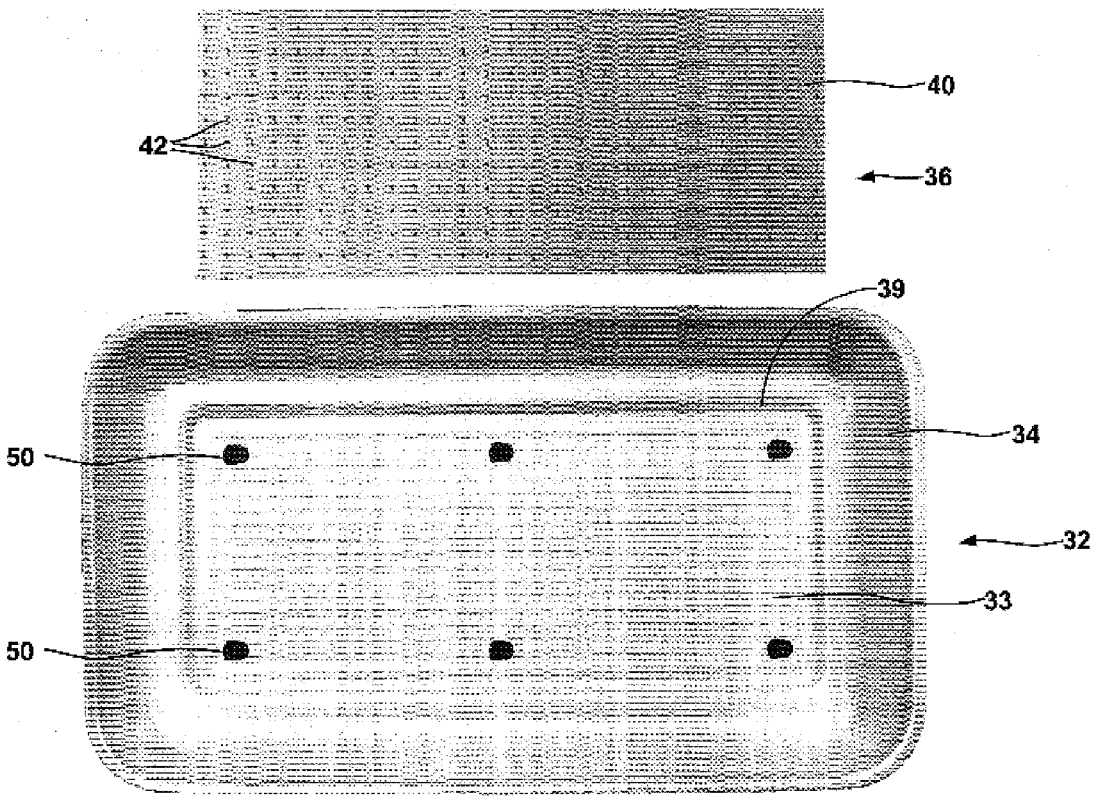
FIG. 5A is a top view of a first embodiment of the foam tray and juice absorbing pad of FIG. 4, prior to assembly.

FIG. 5A is a top view of a first embodiment of the foam tray and juice absorbing pad of FIG. 4, prior to assembly. Referring to FIG. 5A, juice absorbing pad 36 is depicted with perforated side 40 facing upward, thereby showing an array of perforations 42 disposed through perforated side 40. FIG. 5A further depicts a plurality of adhesive dots 50 having been applied immediately prior to assembly of juice absorbing pad 36 with tray 32.

Adhesive dots 50 preferably comprise a liquid adhesive. In one embodiment, foam tray 32 comprised polystyrene closed cell foam, juice absorbing pad comprised open cell polystyrene foam having at least 70 percent open cells, and adhesive dots 50 comprised a low molecular weight polyethylene hot-melt adhesive applied with a hot-melt glue gun. Other adhesives, which suitably adhere to the juice absorbing pad 36 and foam tray 32, and which are inexpensive, easy to apply, and meet FDA and USDA requirements may be suitable. In one embodiment, it is preferred that adhesive dots 50 are elastic, after such dots are fully cured.

In the embodiment shown in FIG. 5A, adhesive dots 50 are applied to the bottom 33 of tray 32. It will be understood that alternatively, adhesive dots 50 may be applied to perforated side 40 of juice absorbing pad 32. In either case, after application of a plurality of adhesive dots 50, assembly of juice absorbing pad 36 to tray 32 is performed by turning perforated side 40 of juice absorbing pad 36 toward bottom 33 of tray 32, and pressing juice absorbing pad 36 against bottom 33 of tray 32, as indicated by arrow 49 of FIG. 4A.

Figure 5B:
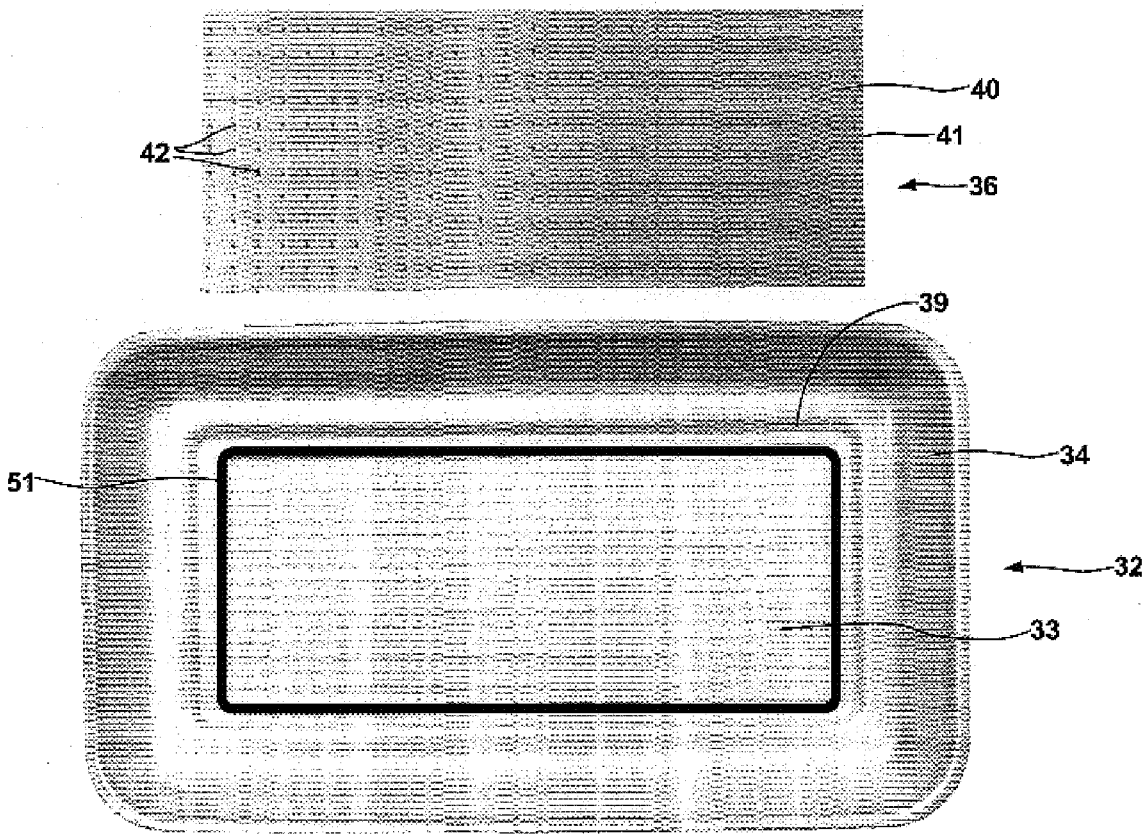
FIG. 5B is a top view of a second embodiment of the foam tray and juice absorbing pad of FIG. 4, prior to assembly.

FIG. 5B is a top view of a second embodiment of the foam tray and juice absorbing pad of FIG. 4, prior to assembly. The embodiment of FIG. 5B is similar to the embodiment described and shown in FIG. 5A, with the exception being that instead of dots of adhesive being used to join pad 36 to tray 32, a continuous bead 51 of adhesive is disposed near the perimeter of bottom 33 of tray 32, formed by step 39. Thus when pad 36 is assembled to tray 32 with perforated side 40 toward bottom 33 of tray 32, interstice 44 (see FIG. 4B) is entirely sealed beneath pad 36, and the height of interstice 44 is defined by the thickness of cured bead 51 of adhesive. Such a continuous bead 51 of adhesive is preferably applied to bottom 33 of tray 32 within between about 0.25 inches and about 0.5 inches of step 39 of tray 32.

Figure 5C:
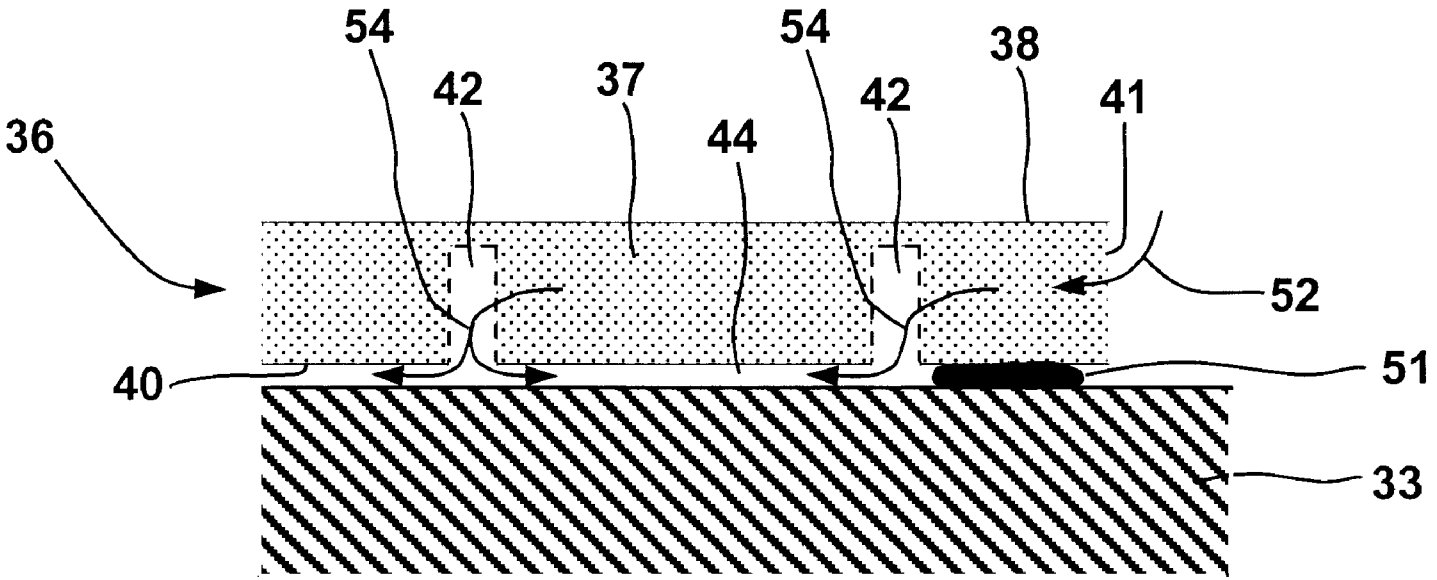
FIG. 5C is a detailed view of a portion of the juice absorbing pad and tray bottom depicted in FIG. 5B and in the sectional view of FIG. 6B, after the juice absorbing pad and tray have been assembled together.

The sealing of interstice 44 beneath pad 36 is advantageous in certain applications of to applicants' juice absorbing package. FIG. 5C is a detailed view of a portion of the juice absorbing pad and tray bottom depicted in FIG. 5B and in the sectional view of FIG. 6B, which depicts the phenomena providing such an advantage. Referring to FIG. 5C, juices are prevented from wicking into interstice 44 beneath pad 36 around the perimeter thereof by bead 51 of adhesive, which is disposed beneath and slightly inside of perimeter 41 of pad 36. However, in this embodiment, juices collected in trench 44 formed between perimeter 41 of pad 36 and step 39 of tray 32 (see FIGS. 6A and 6B) wick into pad 36 through the porous, unsealed perimeter 41 of pad 36, as indicated by arrow 52. Subsequently, juices wick further into pad 36, and when the open cells of pad 36 approach saturation, juices flow out through perforations 42, and into interstice 44, as indicated by arrows 54. Thus, in this embodiment, the provision of a sealing bead 51 of adhesive disposed substantially around the perimeter 41 of pad 36 results in interstice 44 functioning as a compartment that holds additional juices in addition to what pad 36 absorbs.

Through experimentation, applicants have determined ranges of package component properties, which provide acceptable juice absorbing packages and are thus to be considered within the scope of the present invention. Referring to FIGS. 4A–6B, juice absorbing pad 36 is preferably between about 20 mils and about 300 mils thick, depending upon the size and juice content of the food to be packaged, one mil being equal to one one-thousandth (0.001) of an inch. Juice absorbing pad 36 is preferably comprised of open cell foam comprising between about 20 percent and about 90 percent open cells, the open cells thereof containing air comprising about 21 percent oxygen, prior to performing any packaging step that dilutes, purges, or absorbs such oxygen. Such open cell foam preferably comprises open cells having an average diameter of between 1 and 10 mils.

Such open cell foam preferably has a density of between about 1 and about 20 pounds per cubic foot, and such open cell foam preferably has a contact angle of from about zero to about 70 degrees when placed in contact with water. In one preferred embodiment, such open cell foam preferably further comprises from about 0.5 percent to about 15 percent by weight of surfactant, which renders such foam hydrophilic, thereby enhancing juice absorption of such foam.

One measure of the extent to which such foam is made hydrophilic is the contact angle of water upon a cast film of the surfactant-containing polymer comprising such foam. Such contact angle is customarily defined as the angle between the surface of a liquid and the surface of a partially submerged object, or of a container holding the liquid, at the line of contact. In the preferred embodiment, the contact angle of water upon the surfactantcontaining polymer film comprising such foam is between about 0 and about 70 degrees. Referring to FIGS. 5A–6B, the distance between the edge 41 of juice absorbing pad 36 and the step 39 of tray 32 (i.e. the width of trench 44) is between about 0.001 inches and about 0.250 inches, preferably between about 0.025 inches and about 0.125 inches, and more preferably between about 0.040 inches and about 0.080 inches. The interstice 44 between bottom 33 of tray 32 and underside 40 of pad 36 is determined by the cured thickness of adhesive dots 50 or adhesive bead 51, in embodiments in which adhesive is used. In such embodiments interstice 44 is between about 0.001 and about 0.075 inches, preferably between about 0.010 inches and about 0.050 inches, and more preferably between about 0.015 inches and 0.020 inches. In embodiments in which no adhesive is used, e.g. where solvent is used to partially dissolve some area of bottom 33 and underside 40 of pad 36, and then pressing underside 40 of pad 36 against bottom 33, as previously described, interstice 40 is approximately 0.000 inches to about 0.020 inches, the upper limit being determined by the deviation of bottom 33 of tray 32 and/or underside 40 of pad 36 from absolute flatness when such parts are joined together.

In a further embodiment (not shown), pad 36 is made with a serrated edge at perimeter 41, which provides more surface area around perimeter 41. Such additional surface area increases the rate at which pad 36 absorbs juices released by the food contained in the juice absorbing package. Such a serrated edge may be provided by cutting pad 36 using a toothed knife, which preferably has between 10 and 100 teeth per inch of cutting edge thereof.

Figure 6A:
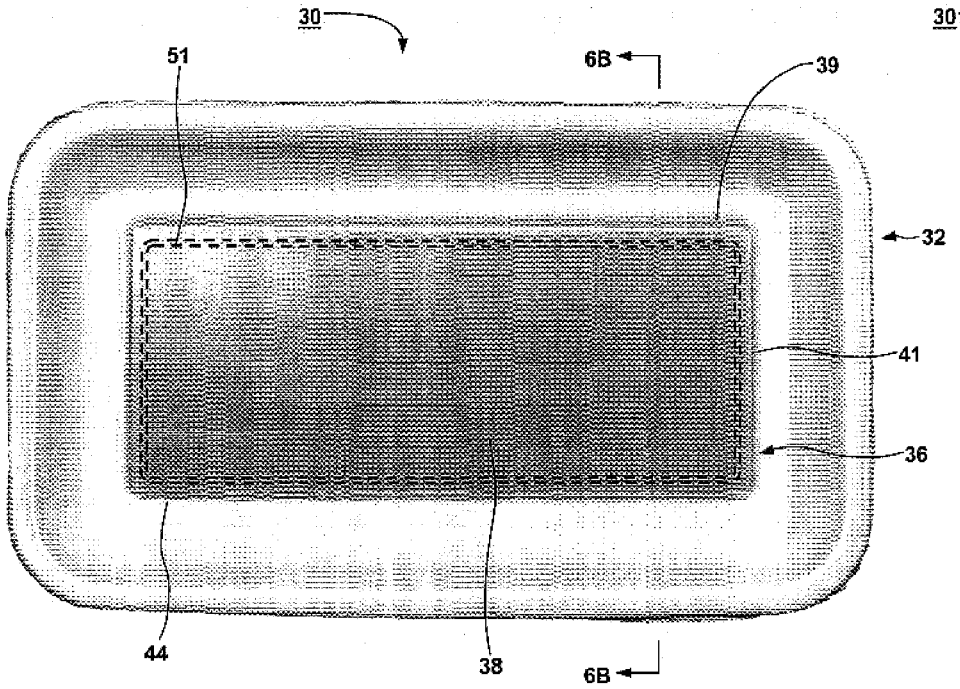
FIG. 6A is a top view of an assembled preferred embodiment of applicants' juice absorbing package.
Figure 6B:
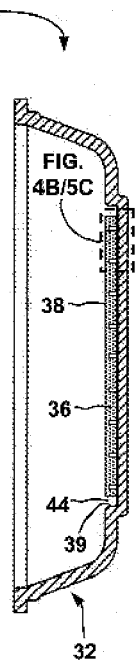
FIG. 6B is a sectional view of the juice-absorbing package of FIG. 6A, taken along line 6B—6B of FIG. 6A.

FIG. 6A is a top view of an assembled preferred embodiment of applicants' juice absorbing package. FIG. 6B is a sectional view of the juice-absorbing package of FIG. 6A, taken along line 6B—6B of FIG. 6A. Referring to FIGS. 6A and 6B, juice absorbing package 30 comprises juice absorbing pad 36 joined to closed cell foam tray 32, with nonperforated side 38 of juice absorbing pad 36 facing outward. In use, a food product (not shown) such as, e.g. a piece meat or fish is placed upon non-perforated side 38 of juice absorbing pad 36, and juice absorbing package 30 is typically fully wrapped with clear stretch wrap film, thereby enclosing the food therein. When juices leak from such food, they flow into a small trench 44 formed between the perimeter 41 of juice absorbing pad 36 and the step 39 of bottom 33 of tray 32. Thus the use of a tray 32 with a countersunk bottom 33 formed by step 39 is preferable over the use of the simple, flat bottomed tray 26 of FIGS. 2A and 2B, because trench 44 is formed by step 39 of tray 32 and perimeter 41 of pad 36, to thereby directing leaked juices into the perimeter 41 of pad 36, and/or into the interstice 44 beneath pad 36.

In addition, in the embodiment depicted in FIGS. 4B and 5A, leaked juices flow into interstice 44 between juice absorbing pad 36 and bottom 33, into perforations 42, and into porous open cell core 37 of pad 36, as indicated by split arrows 46. In this embodiment, applicants' juice absorbing package 30 (see FIG. 6) has a high juice absorbing rate, as well as capacity. Without wishing to be bound by any particular theory, applicant believes that when juice absorbing pad 36 is joined to the bottom 33 of tray 32 by use of dots 50 of elastic adhesive, such elastic adhesive may stretch, enabling juice absorbing pad 36 to separate slightly from the bottom 33 of tray 32, due to the effect of a buoyant force and possibly a capillary force. Accordingly, interstice 44 is increased under the influence of such force, and the rate at which juice is absorbed by pad 36 is enhanced. It will be apparent that the presence of perforations 42 in juice absorbing pad 36 is also important, in that such perforations enable the flow of juices into open cell core 37, through an otherwise impermeable smooth skin on pad 36.

In one embodiment of applicants' juice absorbing package comprising a foam tray, such tray is preferably a closed cell foam tray comprising at least about 50 weight percent polymer having at least about 90 percent closed cells with juice absorbing package further comprising a juice absorbing pad of open cell foam. In use, such a package would be used to package meat, being overwrapped or lidded with PVC film or other suitable stretch wrap. In one further embodiment, the foam material that is formed into such trays is coextruded with a thin surface film that is fusible with such wrap, thereby enabling such wrap to be heat sealed to the foam tray, sealing the meat therein.

In one embodiment, juice absorbing pad 36 was made of open cell polystyrene foam, 0.25-inch thick, 4.6 inches wide, and 10.6 inches long, perforated on one side as shown in FIG. 5, and having a dry weight of 11.0 grams. Tray 32 was formed of material as described above, with a countersunk bottom having a step 39 0.25 inches high, a width of 4.8 inches, and a length of 10.8 inches, thereby forming a trench 44 approximately 0.1 inches wide and 0.25 inches deep for the collection of juices therein.

In an experiment, approximately 120 grams of water (the major constituent of meat juices) was poured into the juice absorbing package of FIG. 6, made with the 11.0 gram juice absorbing pad. It was visually apparent that the majority of such water was wicked into and absorbed by the juice absorbing pad. After one minute, the surplus water was poured from the tray, and the tray plus absorbed water was weighed. The juice absorbing pad absorbed 60.3 grams of water in one minute, i.e. more than five times its weight, demonstrating sufficient juice absorbing capacity and absorption rate for effective use in a juice absorbing package.

Additionally or alternatively to the use of an open cell foam pad for juice absorption, in a further embodiment, one could use a single piece, pieces, or pellets of a super absorbent polymer, such as those described in U.S. Pat. No. 6,458,877, the disclosure of which is incorporated herein by reference.

The aforementioned embodiments of applicants' preferred juice absorbing package are superior to other prior art packages in additional ways. By having the meat, fish, or other food packaged therein resting on the non-perforated skin of the juice absorbing pad, such food is not excessively depleted of juice in the region of contact with the pad. This results in the food having more uniform cooking, texture, and taste properties when prepared and consumed. In addition, the manner in which the juice absorbing package wicks juices inwardly from along the perimeter of such pad, and hides such juices provides a more aesthetically pleasing package, which better promotes retail sale of the food therein. Additionally, by separating the juices from the meat product the possibility of bacterial contamination is reduced and product safety is enhanced.

In further embodiments, the applicants' juice absorbing package further comprises a bactericide. In one embodiment, such a bactericide is disposed throughout a portion or substantially all of the porous structure of the juice absorbing pad. In another embodiment, such a bactericide is disposed through a second pad or a piece fabric placed between the bottom of the tray and the juice absorbing pad.

The present invention is not limited to the use of a closed cell foam tray as the main container of the juice absorbing package. In one further embodiment of applicants' juice absorbing package comprising a foam tray, such tray comprises at least 50 weight percent polymer comprising g between about 20% and about 80% open cells. The foam of such tray is preferably y without surfactant so that such tray is rendered hydrophobic, and will be substantially repellent and non-absorbing of leaked juices. Alternatively, the foam of such tray comprises at least about 50 weight percent hydrophilic polymer surfactant mixture comprising between about 20% and about 80% open cells. The juice absorbing pad of this embodiment preferably comprises open cell foam. In use, such a package would also be used to package meat, and overwrapped or lidded with PVC film or other suitable stretch wrap as described previously.

In another embodiment, applicants' juice absorbing package comprises a tray formed of a gas permeable solid resin, such as polypropylene, polystyrene, low-density polyethylene, amorphous poly(ethylene terephthalate), high-density polyethylene, and suitable mixtures thereof.

In other embodiments, the juice absorbing package of the present invention may be incorporated into other packaging having means to absorb, dilute, displace or control the concentration of oxygen therein. Such packaging is disclosed in applicant's U.S. Pat. No. 6,269,946, 6,269,945, 6,213,294, 6,112,890, 6,210,725, 6,023,915, and U.S. patent applications U.S. Ser. No. 09/906,280 and U.S. Ser. No. 10/280,034 the disclosures of which are incorporated herein by reference.

Thus, the previously described embodiments of the juice absorbing package comprising a closed cell foam tray, or an open cell foam tray without surfactant, or a gaspermeable solid resin tray, may be overwrapped or lidded with highly gas permeable film and placed in heat shrinkable barrier valve bag containing means for flowing a non-oxidizing gas such as carbon dioxide therein, as described in applicant's co-pending patent applications U.S. Ser. No. 10/280,034 and U.S. Ser. No. 09/906,280. Such a package would be advantageous in that it would provide juice absorbing capability, and an extended shelf life by reducing the exposure of the food packaged therein to oxygen.

In another embodiment having such advantages, the juice absorbing package comprising a closed cell foam tray, or an open cell foam tray without surfactant, or a gaspermeable solid resin tray, further comprises an oxygen absorber, disposed within such package, overwrapped, and placed in heat shrinkable barrier bag. The oxygen absorber may be a separate item, such as a packet comprising an oxygen absorbing material, such as iron powder. Such oxygen absorbing materials and packets are described in e.g., U.S. Pat. Nos. 6,436,872- 6,248,690, 6,156,231 of McKedy, the disclosures of which are incorporated herein by reference. Such oxygen absorbing packets are well known and are commercially available from suppliers such as e.g., Multisorb, Inc. of Buffalo, NY.

Figure 7A:
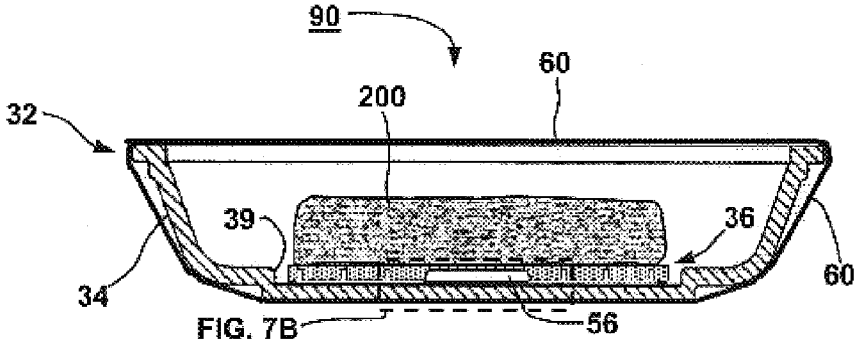
FIG. 7A is a sectional view of an embodiment of a juice and oxygen absorbing package comprising an oxygen absorbing packet.
Figure 7B:
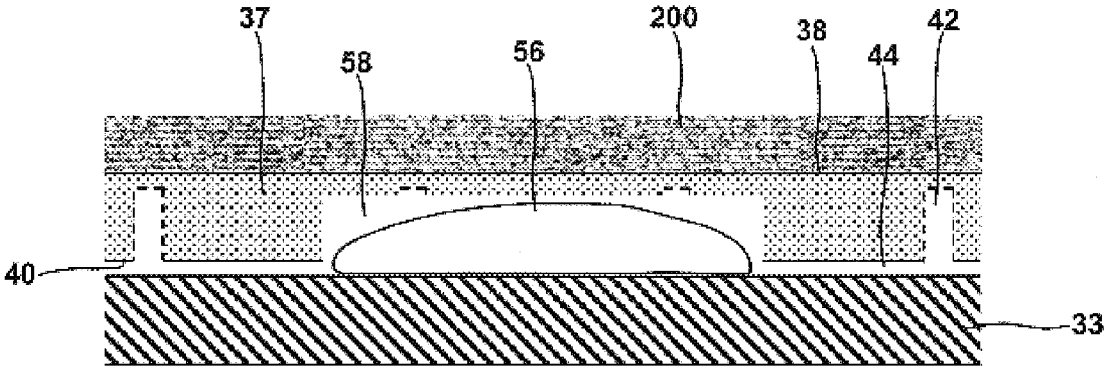
FIG. 7B is an enlarged detailed view of a portion of the juice and oxygen absorbing package of FIG. 7A, depicting the oxygen absorbing packet therein.

FIG. 7A is a sectional view of one preferred embodiment of a juice and oxygen absorbing package comprising an oxygen absorbing packet. FIG. 7B is an enlarged detailed view of a portion of the juice and oxygen absorbing tray of FIG. 7A, depicting the oxygen absorbing packet therein. Referring to FIGS. 7A and 7B, oxygen absorbing packet 56 is disposed in package 90, which is overwrapped by film 60. In the preferred embodiment, oxygen absorbing packet is disposed upon bottom 33 of tray 32, beneath juice absorbing pad 36, within a pocket 58 formed therein. Such a placement of oxygen absorbing packet provides for a more aesthetically pleasing appearance to the consumer.

In yet a further embodiment alternatively or additionally to an oxygen absorbing packet, the function of oxygen absorption is provided by an oxygen absorbing composition incorporated within or coated onto the tray, absorbent pad and/or film used as an overwrap or lid for the tray of the package. One suitable oxygen absorbing composition is comprised of an oxygen scavenging polymer as described in U.S. Pat. No. 6,455,620 of Cyr et al, the disclosure of which is incorporated herein by reference. Thus in the preferred embodiment of FIG. 7A, overwrap 60, tray 32, and/or pad 36 further comprise an oxygen scavenging polymer, which reduces the exposure of the meat 200 contained within package 90 to oxygen, thereby increasing the shelf life of meat 200.

Figure 8:
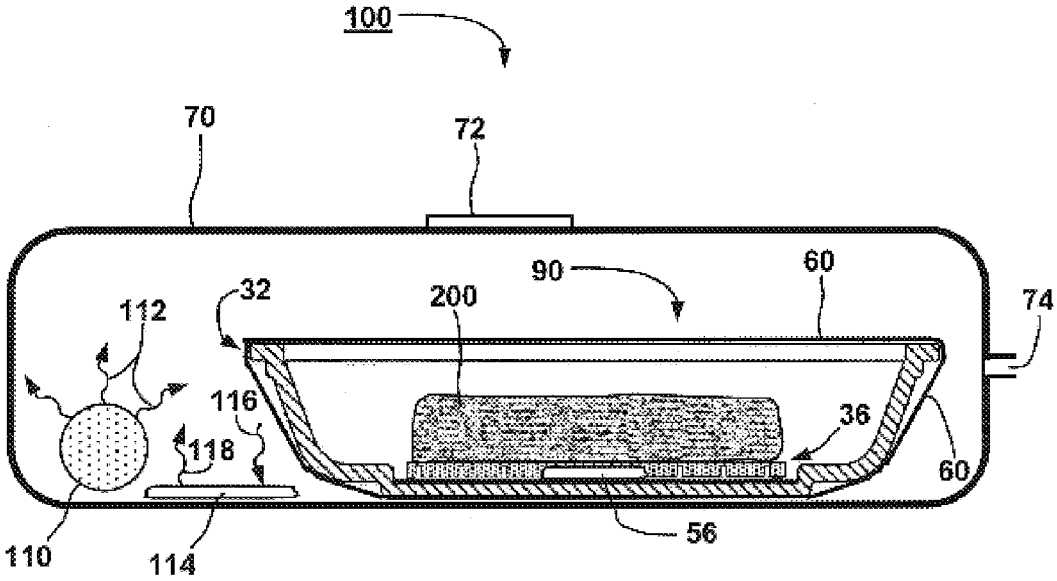
FIG. 8 is a sectional view of one preferred barrier packaging system for absorbing juice and absorbing and/or purging oxygen from the atmosphere therein, comprising the overwrapped juice and oxygen absorbing tray of FIG. 7A, disposed within a valved barrier bag.

FIG. 8 is a sectional view of one preferred barrier packaging system for absorbing juice and absorbing and/or purging oxygen from the atmosphere therein, comprising the overwrapped juice and oxygen absorbing tray of FIG. 7A, disposed within a valved barrier bag. Referring to FIG. 8, in one embodiment, the oxygen and juice absorbing package 90 is disposed through opening 74 in a beat shrinkable barrier bag 70 as described in applicant's pending U.S. patent application U.S. Ser. No. 10/280,034. The opening 74 of such barrier bag 70 is sealed, such barrier bag is heat-shrunk, and the atmosphere within bag 70 is evacuated through one-way valve 72, as described in applicant's aforementioned pending application and in applicant's U.S. Pat. Nos. 6,269,945, 6,269,946, 6,213,294, 6,112,890, and 6,210,725.

In another embodiment, alternatively or additionally to oxygen absorbing packet 56, a source of non-oxidizing gas is disposed within barrier bag 70. Referring again to FIG. 8, a piece 110 of solid carbon dioxide is disposed within barrier bag 70, prior to the sealing of opening 74. Subsequently, solid carbon dioxide piece 110 sublimes as indicated by arrows 112, purging the air therein, and providing a non-oxidizing atmosphere. Accordingly, the exposure of meat 200 contained in package 100 to oxygen is substantially eliminated, thereby greatly extending the shelf life of such meat prior to purchase.

In another embodiment, alternatively or additionally to solid carbon dioxide piece 110, a carbon dioxide producing sachet is disposed within barrier bag 70. Such sachets are well known and are commercially available from suppliers such as e.g., CO2 Technologies of West Des Moines Iowa. In the embodiment depicted in FIG. 8, sachet 114 is disposed within barrier bag 70, and when moisture diffuses into sachet 114 as indicated by arrow 116, carbon dioxide is produced by a chemical reaction, an is released into barrier bag 70, as indicated by arrow 118.

In another embodiment, tray 32 is provided with additional volume, and an additional compartment therein, in which the piece of solid carbon dioxide is disposed prior to the wrapping of tray 32 with film 60, and the sealing of package 90 in barrier bag 70, as described in the aforementioned applicant's Pat. No. 6,269,946.

It is, therefore, apparent that there has been provided, in accordance with the present invention, a food packaging tray with an integral juice absorbing bottom. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A food package comprising a tray having a bottom bounded by an upwardly extending lip around the perimeter of said bottom and a liquid-absorbing pad comprised of polymer foam joined to said bottom of said tray, wherein (a) said polymer foam is comprised of between about 20 to about 90 percent open cells, (b) said polymer foam has an average cell diameter of between about 1 and about 10 mils, (c) said polymer foam has a density of between about 1 and about 20 pounds per cubic foot, and (d) said polymer foam has a contact angle when placed in contact with water of about 0 to about 70 degrees.

2. The food package as recited in claim 1, wherein said polymer foam contains between about 0.5 and about 15 weight percent of surfactant.

3. The food package as recited in claim 1, wherein said tray further comprises a step disposed around said perimeter of said bottom and wherein said step and said bottom form a countersunk volume within said tray.

4. The food package as recited in claim 1, wherein said tray is comprised of at least 50 weight percent of polymer.

5. The food package as recited in claim 4, wherein said closed cell foam comprises at least 90 percent of closed cells.

6. The food package as recited in claim 4, wherein said tray further comprises a step disposed around said perimeter of said bottom and wherein said step and said bottom form a countersunk volume within said tray.

7. The food package as recited in claim 1, wherein said pad has a thickness of between about 20 mils and about 300 mils.

8. The food package as recited in claim 1, wherein said tray comprises at least 50 weight percent hydrophilic polymer surfactant mixture comprising between about 20% and about 80% open cells.

9. The food package as recited in claim 1 wherein said tray comprises at least 50 weight percent hydrophobic polymer comprising between about 20% and about 80% open cells.

10. The food package as recited in claim 9, wherein said tray further comprises a step disposed around said perimeter of said bottom, and a countersunk volume formed by said step and said bottom.

11. The food package as recited in claim 1, wherein said tray is comprised of a gas permeable solid resin.

12. The food package as recited in claim 11, wherein said tray further comprises a step disposed around said perimeter of said bottom and wherein said step and said bottom form a countersunk volume within said tray.

13. The food package as recited in claim 3, wherein said liquid absorbing pad further comprises an impermeable surface and a plurality of perforations disposed through said impermeable surface.

14. The food package as recited in claim 13, wherein said impermeable surface of said liquid absorbing pad is disposed adjacent to said bottom of said tray.

15. The food package as recited in claim 14 wherein said liquid absorbing pad is joined to said bottom of said tray with adhesive.

16. The food package as recited in claim 15, wherein said adhesive is elastic adhesive when said adhesive is in a cured state.

17. The food package as recited in claim 15, wherein said adhesive is disposed between said juice absorbing pad and said bottom of said tray in a plurality of dots.

18. The food package as recited in claim 15, wherein said adhesive is disposed between said juice absorbing pad and said bottom of said tray in a continuous bead.

19. The food package as recited in claim 18, wherein said continuous bead of adhesive is to disposed on said bottom of said tray within between about 0.25 inches and about 0.5 inches of said step of said tray.

20. The food package as recited in claim 3, wherein said liquid absorbing pad is disposed within said countersunk volume and wherein said liquid absorbing pad and said step form a trench between said step of said tray and the perimeter of said liquid absorbing pad of between about 0.025 inches and about 0.125 inches wide.

21. The food package of claim 20, wherein said trench is between about 0.001 inches and about 0.250 inches wide.

22. The food package as recited in claim 3, wherein said liquid absorbing pad is disposed within said countersunk volume and wherein said liquid absorbing pad and said bottom of said tray forming an interstice between said liquid absorbing pad and said bottom of said tray between about 0.00001 inches and about 0.075 inches.

23. The food package as recited in claim 22, wherein said interstice is between 0.00001 and 0.020 inches.

24. The food package as recited in claim 22, wherein said interstice is between 0.010 and 0.050 inches.

25. The food package as recited in claim 1, wherein said juice absorbing pad further comprises a bactericide.

26. The food package as recited in claim 1, further comprising a film overwrapping around said tray.

27. The food package as recited in claim 26, further comprising an oxygen absorbing substance disposed within said tray.

28. The food package as recited in claim 27 wherein said oxygen absorbing substance is disposed in an oxygen absorbing packet.

29. The food package as recited in claim 27 wherein said oxygen absorbing packet is disposed between said juice absorbing pad and said bottom of said tray.

30. The food package as recited in claim 26, wherein said tray and said film overwrapping are disposed within a barrier bag.

31. The food package as recited in claim 30, wherein a non-oxidizing gas is disposed within said barrier bag.

32. The food package as recited in claim 31, wherein said non-oxidizing gas is carbon dioxide.

33. The food package as recited in claim 32 wherein said carbon dioxide further comprises solid carbon dioxide disposed within said barrier bag.

34. The food package as recited in claim 31 wherein said non-oxidizing gas is produced by a sachet disposed within said barrier bag.

* * * * *